US006276970B1

(12) United States Patent
Wong

(10) Patent No.: US 6,276,970 B1
(45) Date of Patent: Aug. 21, 2001

(54) FLAT F-PORT COAXIAL ELECTRICAL CONNECTOR

(76) Inventor: Shen-Chia Wong, No. 10, Lane 121, Li-Der Rd., Peito District, Taipei (TW)

( * ) Notice: Subject to any disclaimer, the term of this patent is extended or adjusted under 35 U.S.C. 154(b) by 0 days.

(21) Appl. No.: 09/688,148

(22) Filed: Oct. 16, 2000

(51) Int. Cl.[7] ..... H01R 9/05
(52) U.S. Cl. ..... 439/638; 439/578
(58) Field of Search ..... 439/638, 628, 439/944, 578, 584, 654

(56) References Cited

U.S. PATENT DOCUMENTS 4,596,434 * 6/1986 Saba et al. ..... 439/578
5,498,175 * 3/1996 Yeh et al. ..... 439/578
5,667,409 * 9/1997 Wong et al. ..... 439/654
5,863,226 * 1/1999 Lan et al. ..... 439/852
5,980,326 * 11/1999 Weidner et al. ..... 439/675

* cited by examiner

*Primary Examiner*—Tulsidas Patel
(74) *Attorney, Agent, or Firm*—Dougherty & Troxell

(57) ABSTRACT

A flat F-port coaxial electrical connector disclosed herein comprises a connector body and a terminal structure. The connector body has an annular stopper protrusion which is able to engage with a second insulation adapter by inlaying into the outer surface of the second insulation adapter so that the terminal of the conductor body is formed into a flat surface. With this structure, when the electrical connector of the present invention is engaged with a F-type male connector, the mating surface can be maintained in smooth and flat finished state thereby preventing electromagnetic signal leakage.

6 Claims, 7 Drawing Sheets

FLAT F-PORT COAXIAL ELECTRICAL CONNECTOR

BACKGROUND OF THE INVENTION (1) Field of the Invention

The present invention relates to a flat F-port coaxial electrical connector, and more particularly, to a flat F-port coaxial electrical connector when the terminal structure is engaged to the connector body, a second insulator adapter of the terminal structure is conjoined to an annular stopper protrusion of the conductor body so that the terminal of the conductor body is formed into a flat surface. With this structure, when the electrical connector of the present invention is engaged with a F-type male connector, the mating surfaces can be maintained in smooth and finished state thereby preventing electromagnetic signal leakage.

(2) Description of the Prior Art

Recently, the inventor of the present invention acquired a US patent regarding a coaxial cable connector titled "Flat F-port coaxial electrical connector". This patent is published in U.S. Pat. No. 6,113,431 dated Sep. 5, 2000. In aforesaid patent, an improvement was made to eliminate shortcomings arose from the conventional technique wherein a plastic terminal was directly riveted to the connector body after fitted with an annular collar, and in stead, in the aforesaid patented invention, flat sections at the two extremities of the cable connector body were formed in order to maintain flatness and smoothness when it was engaged with a F-type male connector thereby preventing electromagnetic signal leakage.

After being carried out further study and experimentation, the present inventor discovered there is still an improvement can be made for engagement technique of the aforesaid invention between the containment hole and the second insulating adapter so that production cost can be further reduced and manufacturing efficiency more improved, and similarly, there will be formed flat surfaces at both side of the connector body terminal.

SUMMARY OF THE INVENTION

Accordingly, it is a main object of the present invention to provide a flat F-port coaxial electrical connector having an annular stopper protrusion to be inlaid into and fixedly engaged with a second insulating adapter of the terminal structure.

It is another object of the present invention to provide a flat F-port coaxial electrical connector having an annular sleeve provided at a port formed in the connector body so as to form planar surfaces at the connector body terminal, and by engaging the annular sleeve fixedly with the terminal structure, when the connector body is engaged with a F-port male connector, the mating surfaces can be maintained in smooth and finished state thereby preventing electromagnetic signal leakage.

For fuller understanding of the nature and objects of the invention, reference should be made to the following detailed description taken in conjunction with the accompanying drawings below. Meanwhile, the accompanying drawings are provided for purposes of reference and explanation, and by no means are construed as limitations applicable to the invention herein.

DETAILED DESCRIPTION OF THE INVENTION

Figure 1:
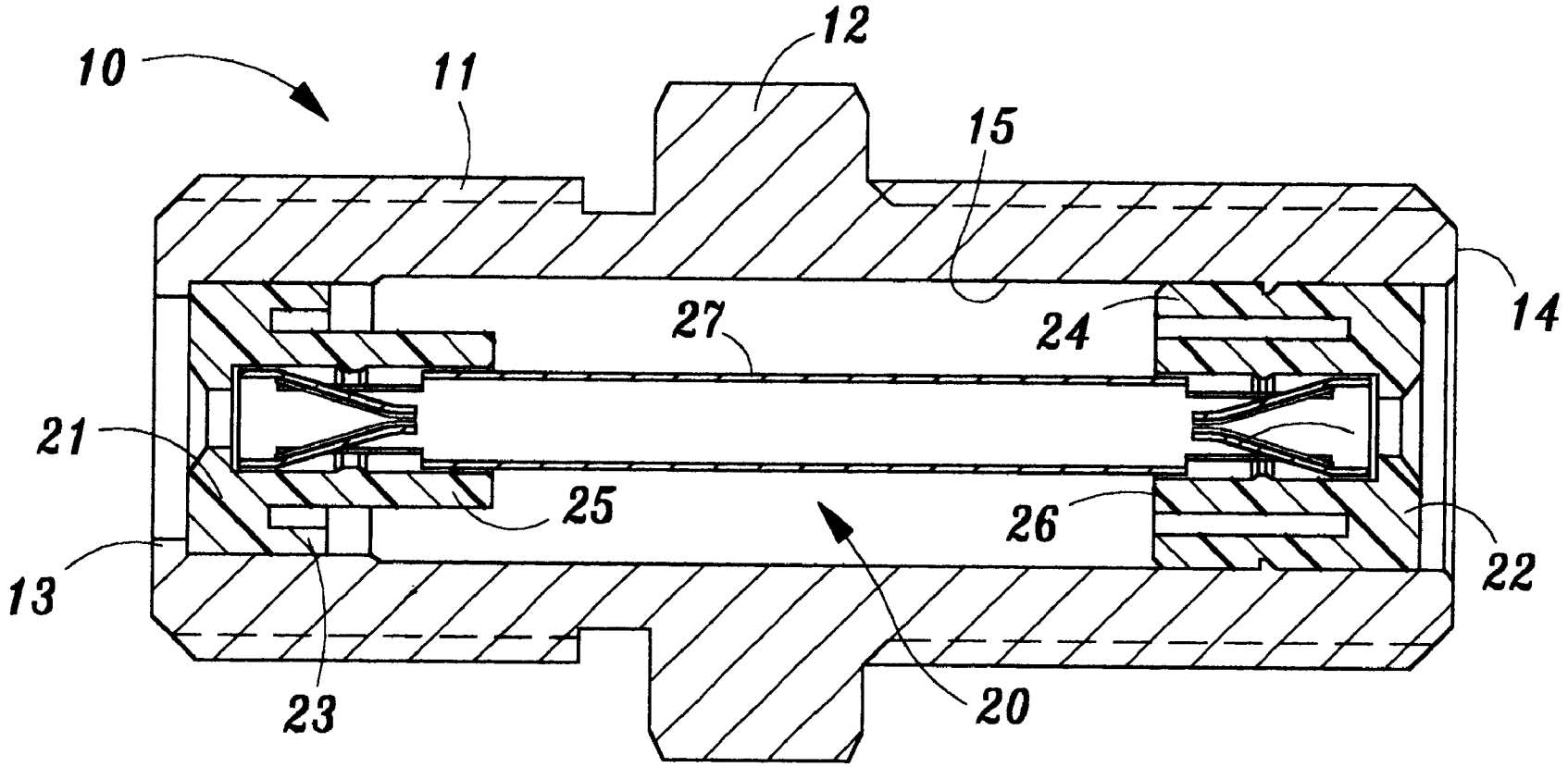
FIG. 1 is a cross-sectional drawing of a first embodiment of the present invention.
Figure 2:
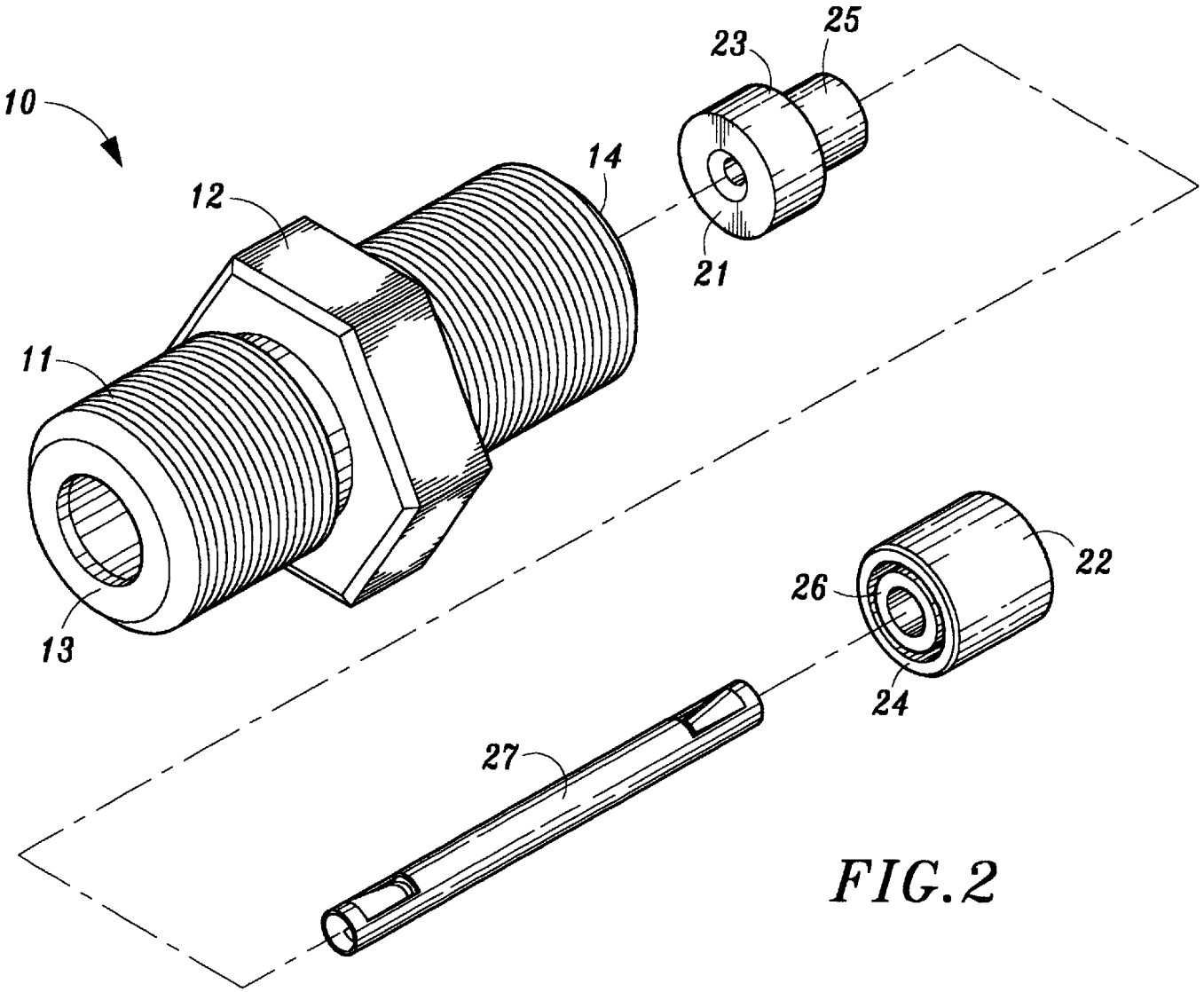
FIG. 2 is a three dimensional exploded view of a first embodiment of the present invention.

Referring to FIG. 1 and FIG. 2, simultaneously, the flat F-port coaxial electrical connector in a first embodiment of the present invention comprises a connector body 10 and a terminal structure 20.

Figure 3:
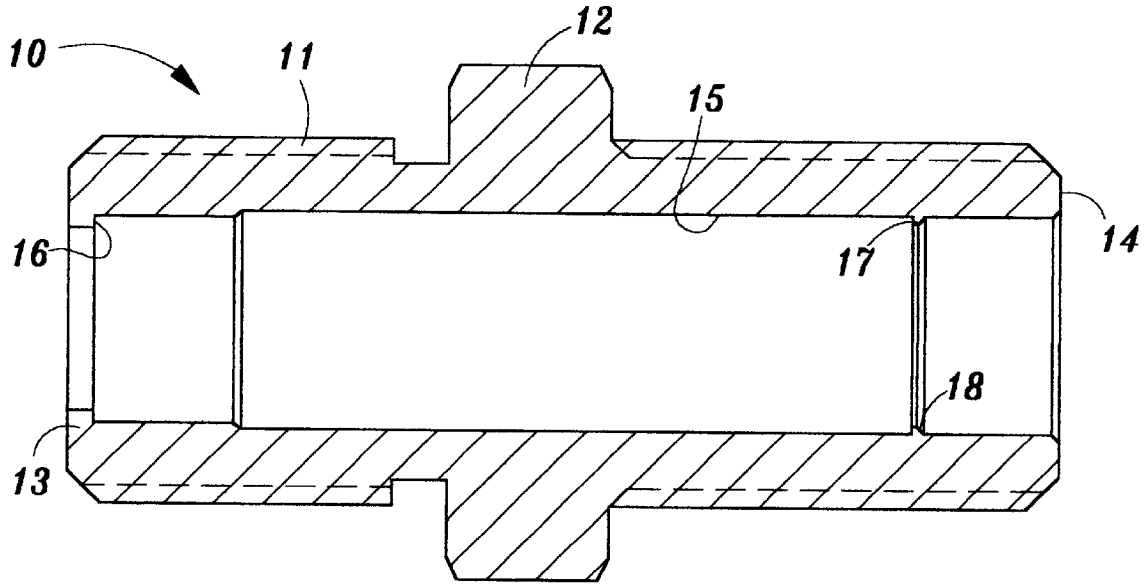
FIG. 3 is a cross-sectional view of the connector body in a first embodiment of the present invention.

Referring to FIG. 3, the connector body 10 further includes a threaded section 11, a hexagonal section 12, a first planar section 13, and a second planar section 14. A containment hole 15 having a diameter enough to accept the terminal structure 20 is formed in the connector body 10. The inner space of the containment hole 15 is terminated at an annular flat bottom 16. An annular stopper protrusion 17 is formed in the container hole 15 near the second planar section 14 so as to detain fixedly the terminal structure 20 thereat, and a conical portion 18 formed at the fringe of the stopper protrusion 17 is for facilitating the terminal structure 20 to slip into the containment hole 15.

Figure 4:
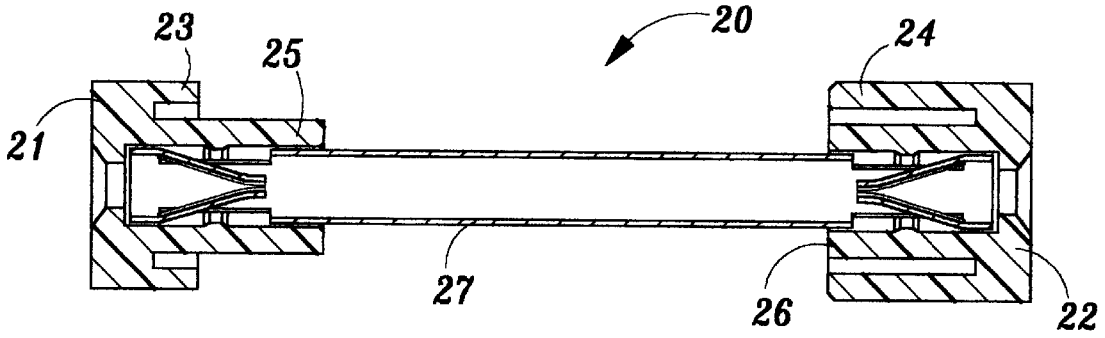
FIG. 4 is a cross sectional view of the terminal structure in all three embodiment of the present invention.

As shown in FIG. 4, the terminal structure 20 includes a first insulation adapter 21 and a second insulation adapter 22. These first and second insulation adapters 21, 22 include respectively outer enclosure sections 23, 24 and elastic annular clipping sections 25, 26. A tubular contact member 27 is interlaid between the two clipping sections 25, 26. A flare inlet is formed near the terminal of the tubular contact member 27 for accepting insertion of a F-type male connector to achieve electrical connection. Both first and second insulating adapter 21, 22 are made of plastic materials such as PE, PP, PC or other rubber.

In connecting to a flat F-port coaxial electrical connector with a coaxial cable, at first, inserting the terminal structure 20 into the containment hole 15 of the connector body 10 until the terminal of the first insulation adapter 21 mates with the annular flat bottom 16. As shown in FIG. 1, the annular stopper protrusion 17 is able to forcibly inlay into the outer surface of the second insulation adapter 22 by a compressive force given rise by properly designed mutually relating size between the containment hole 15 and the second insulation adapter 22. As a result, the terminal structure 20 can be securely and reliably fixed in the connector body 10 and keep smoothness and flatness of the nearly surfaces where the coaxial electrical connector of the present invention is mating with the F-type male connector.

Figure 5:
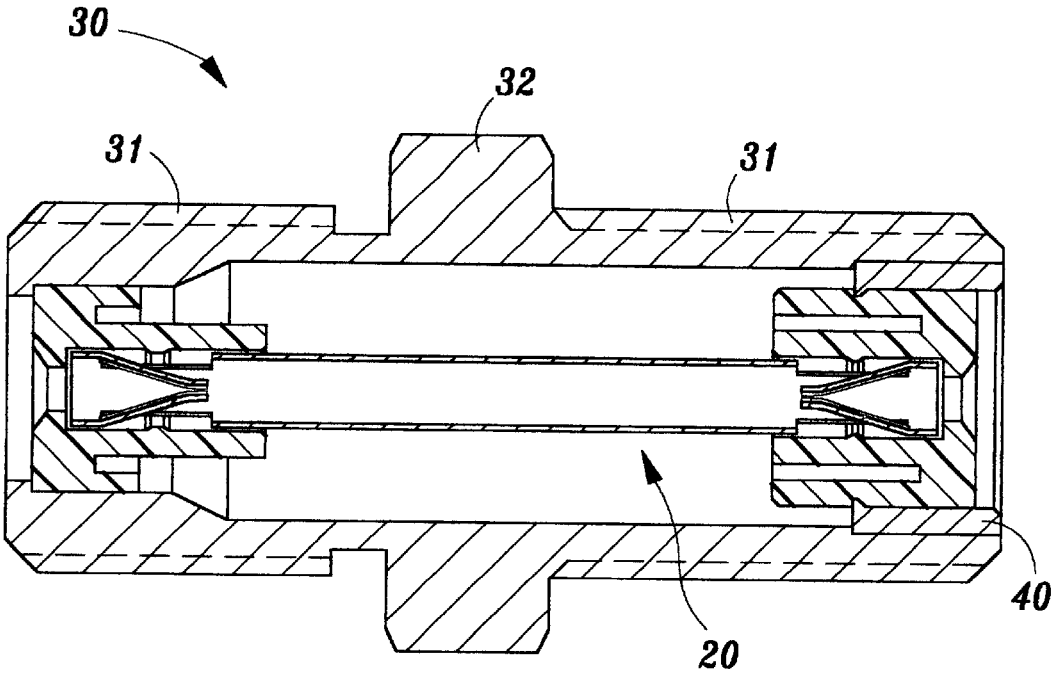
FIG. 5 is a cross-sectional view of a second embodiment of the present invention.

Referring to FIG. 5, the flat F-port coaxial electrical connector in a second embodiment of the present invention comprises a connector body 30, a terminal structure 20, and an annular sleeve 40.

Figure 6:
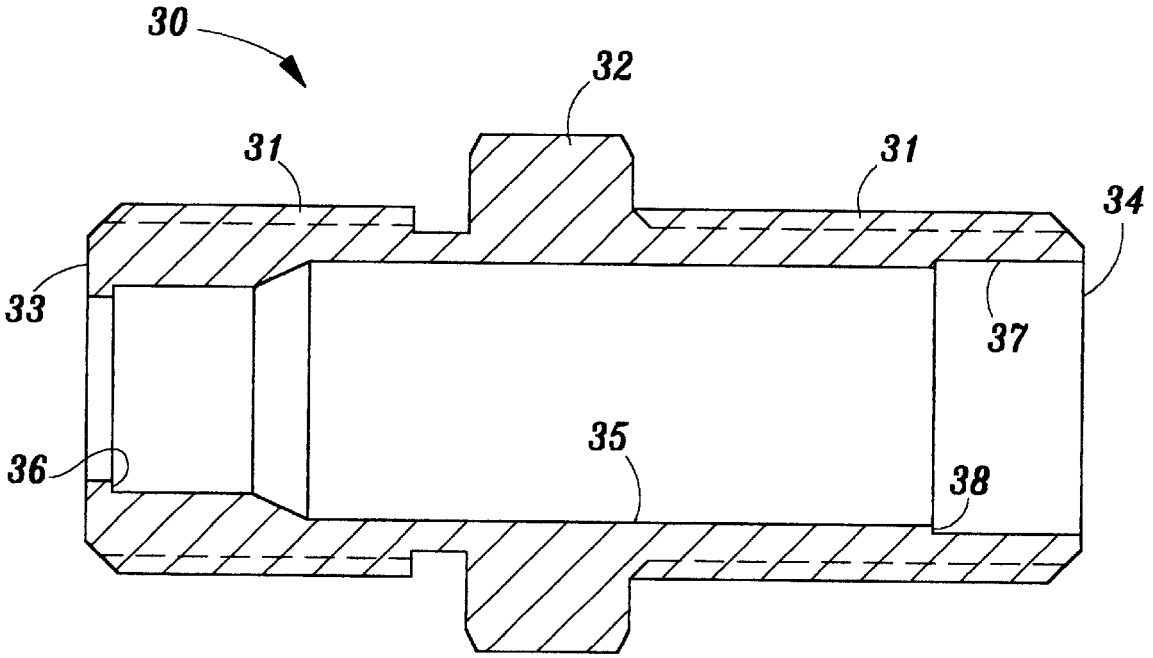
FIG. 6 is a cross-sectional view of the connector body in a second embodiment of the present invention.

Referring to FIG. 6, the connector body 30 further includes a threaded section 31, a hexagonal section 32, a first planar section 33, and a port 34. A containment hole 35 having a diameter enough to accept the terminal structure 20 is formed in the connector body 30. The inner space of the containment hole 35 is terminated at an annular flat bottom 36. An annular groove 37 is formed in the containment hole 35 at the terminal of the port 34, and the inner portion of the annular groove 37 is terminated at another annular flat bottom 38.

In the second embodiment, the terminal structure 20 also includes a first insulation adapter 21, a second insulation adapter 22, and a tubular contact member 27 as shown in FIG. 4.

Figure 7:
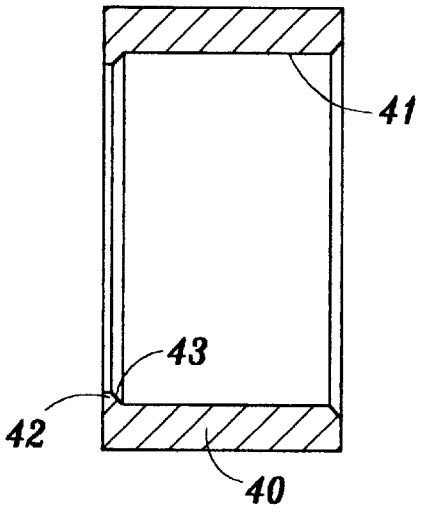
FIG. 7 is a cross sectional view of the annular sleeve in a second embodiment of the present invention.

Referring to FIGS. 4 and 7, the inner portion of the annular sleeve 40 defines a through hole 41 forming an annular stopper protrusion 42 at its end thereof for fixedly detaining the second insulation adapter 22 therewith. The contact surface between the stopper protrusion 42 and the through hole 41 is formed into a conical portion 43 so as to facilitate insertion of the first and the second insulation adapters 21 and 22 into the through hole 41.

Figure 8:
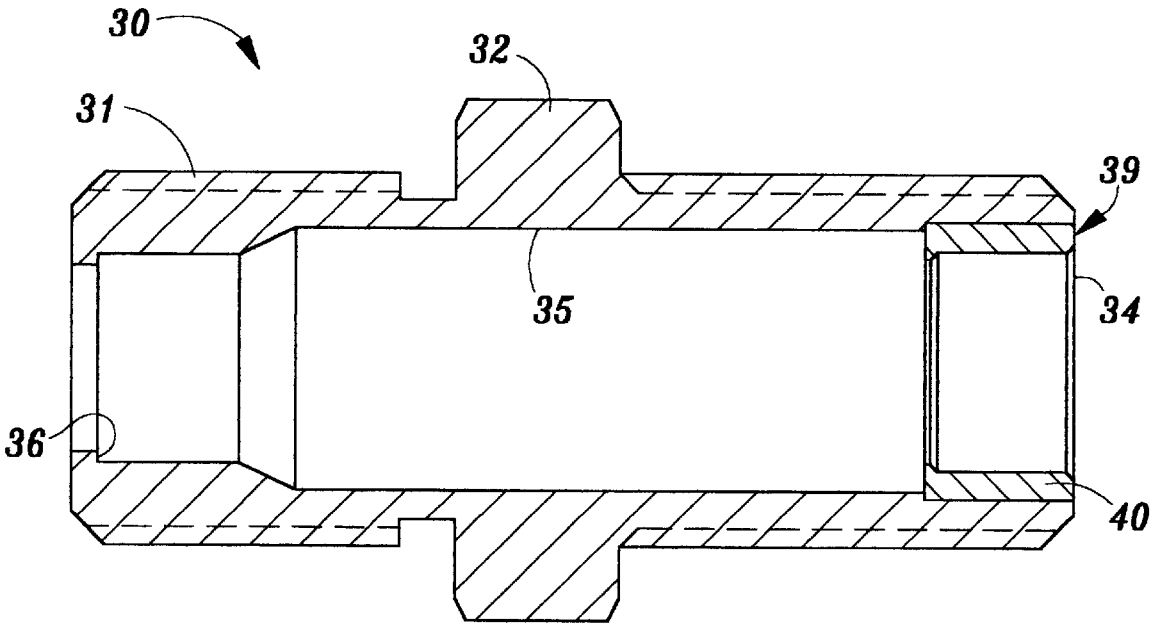
FIG. 8 is a cross sectional view showing the annular sleeve being in engagement with the connector body in a second embodiment of the present invention.

In connecting a flat F-port coaxial electrical connector with a coaxial cable, at first, pushing the annular sleeve 40 into the annular groove 37 in the connector body 30 until the terminal of the sleeve 40 mates with the annular flat bottom 38 as so to bring the annular sleeve 40 in engagement with the annular groove 37. With this structure, the port 34 of the connector body 30 is formed into a planar portion 39 as shown in FIG. 8. Finally, inserting the terminal structure 20 into the containment hole 35 of the connector body 30 until the terminal of the first insulation adapter 21 mates with the annular flat bottom 36. As shown in FIG. 5, the annular stopper protrusion 42 is able to forcibly inlay into the outer surface of the second insulation adapter 22 by a compressive force given rise by properly designed mutually relating size between the containment hole 35 and the second insulation adapter 22. As a result, the terminal structure 20 can be securely and reliably fixed in the connector body 30.

Figure 9:
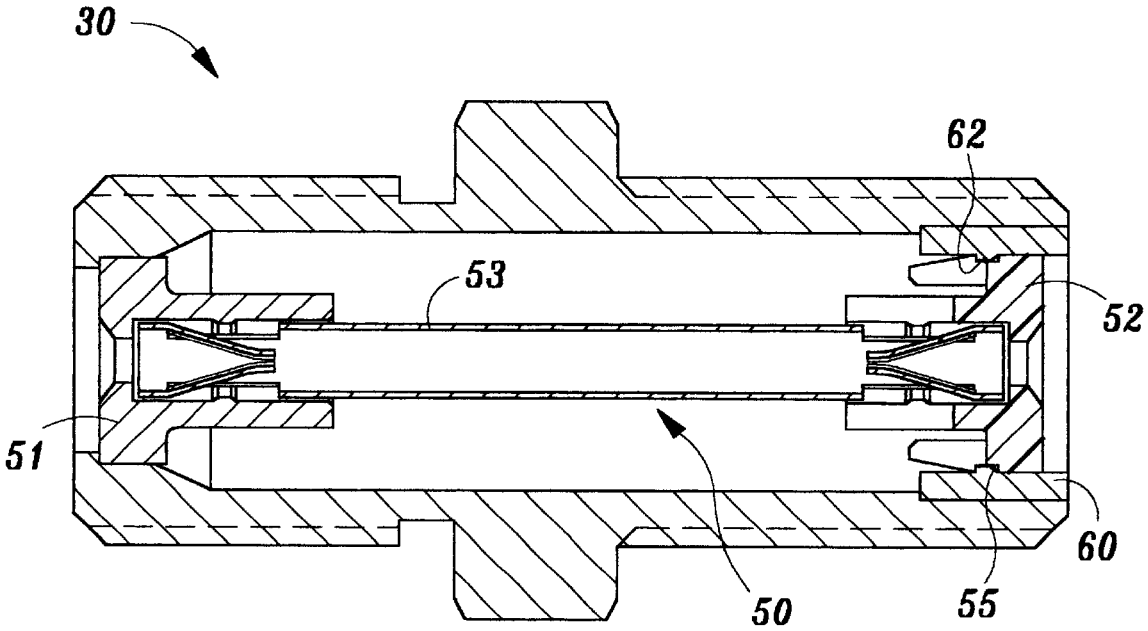
FIG. 9 is a cross sectional view of a third embodiment of the present invention.

Referring to FIG. 9, the flat F-port coaxial electrical connector in a third embodiment of the present invention comprises a connector body 30, a terminal structure 50, and an annular sleeve 60.

Figure 10:
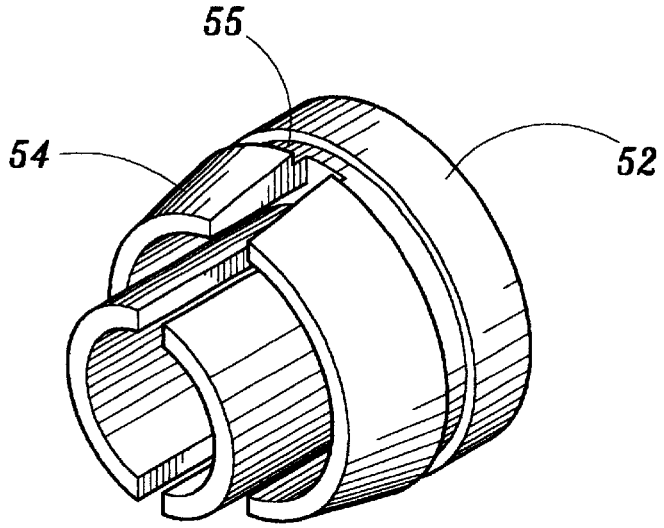
FIG. 10 is a three-dimensional perspective view of a second insulating adapter in a third embodiment of the present invention.

As shown in FIGS. 9, 10, the terminal structure 50 further includes a first insulation adapter 51, a second insulation adapter 52, and a tubular contact member 53. The first and the second insulation adapters 51 and 52 are made of plastic materials. An annular outer enclosure 54 on the second insulator adapter 52 has an annular recessed slot 55 on its outer surface thereof.

Figure 11:
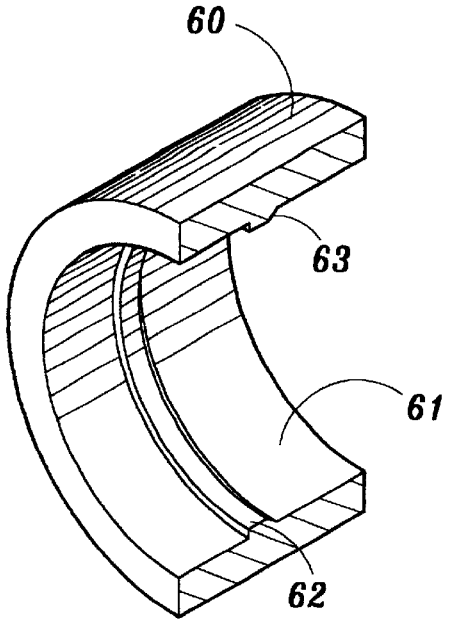
FIG. 11 is a fragmentary drawing of an annular sleeve in a third embodiment of the present invention.

Referring to FIG. 11, the annular sleeve 60 is made of metallic material; a through hole 61 is formed within the sleeve 60. An annular stopper protrusion 62 is formed in the through hole 61 so that the stopper protrusion 62 can be inlaid in annular recessed slot 55 of the second insulation adapter 52 and fixed therein. The contact surface between the stopper protrusion 62 and the through hole 61 is formed into a conical portion 63 so as to facilitate insertion of the first and second insulation adapters 51 and 52 into the through hole 61.

Figure 12:
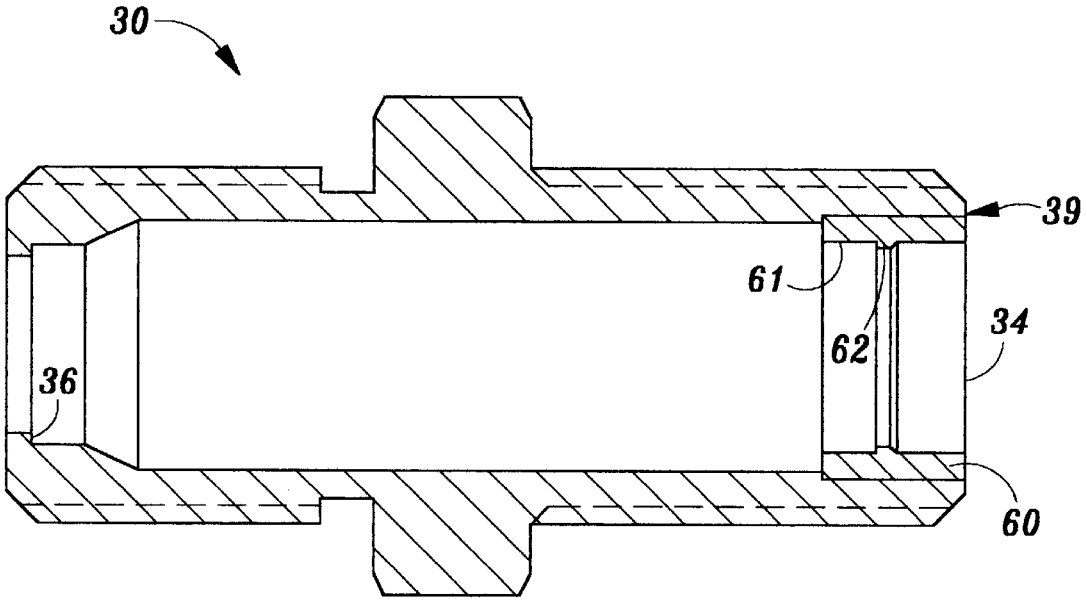
FIG. 12 is a cross sectional view showing the annular sleeve being in engagement with the connector body in a third embodiment of the present invention.

In connecting a flat F-port coaxial electrical connector with a coaxial cable, let us refer to FIGS. 6, 11 and 12, at first, pushing the annular sleeve 60 into the annular groove 37 in the connector body 30 until the terminal of the sleeve 60 mates with the annular flat bottom 38 so as to bring the annular sleeve 60 in engagement with the annular groove 37. With this structure, the port 34 of the connector body 30 is formed into a planar portion 39. Finally, inserting the terminal structure 50 into the through hole 61 of the sleeve 60 until the terminal of the first insulation adapter 51 mates with the annular flat bottom 36. By so, the annular recessed slot 55 and the stopped protrusion 62 are firming engaged with each other as shown in FIG. 9. As a result, the terminal structure 50 is securely and reliably fixed in the connector body 30.

While it will be apparent that the preferred embodiments of the invention disclosed are well calculated to provide the advantages and features above stated, it will be appreciated that the invention is susceptible to modification, variation and change without departing from the proper scope or fair meaning of the subjoined claims.

What is claimed is:

1. A flat F-port coaxial electrical connector comprising:

a) a connector body having threaded opposite end portions with a hexagonal nut between the end portions, a first planar section and a lengthwise containment hole, the connector body also having an annular groove extending inwardly from a first end thereof;

b) a tubular contact located in the containment hole;

c) a first insulation adapter mounted on the tubular contact and sized so as to slidably fit into the containment hole through the first end of the connector body;

d) an annular sleeve located in the annular groove in the connector body, the annular sleeve having a through hole and an annular stopper protrusion extending inwardly into the through hole; and, e) a second insulation adapter mounted on the tubular contact, and located in the through hole of the annular sleeve whereby the annular stopper engages an outer surface of the second insulation adapter to fix the second insulation adapter therein.

2. The flat F-port coaxial electrical connector of claim 1 wherein the annular stopper has a conical cross-sectional configuration.

3. The flat F-port coaxial electrical connector of claim 1 wherein the second insulation adapter is made of a material selected from the group consisting of plastic and rubber, and wherein the annular stopper extends into the material of the second insulation adapter.

4. The flat F-port coaxial electrical connector of claim 1 wherein the annular stopper extends inwardly from an end of the annular sleeve.

5. The flat F-port coaxial electrical connector of claim 1 wherein the annular stopper extends inwardly from a position spaced from opposite ends of the annular sleeve.

6. The flat F-port coaxial electrical connector of claim 1 further comprising an annular recessed slot in the outer surface of the second insulation adapter located so as to be engaged by the annular stopper.

* * * * *